US010581167B2

(12) United States Patent
Ryu et al.

(10) Patent No.: US 10,581,167 B2
(45) Date of Patent: Mar. 3, 2020

(54) ELECTRONIC DEVICE

(71) Applicant: LG ELECTRONICS INC., Seoul (KR)

(72) Inventors: Seungwoo Ryu, Seoul (KR); Joohee Lee, Seoul (KR); Wonwoo Lee, Seoul (KR); Junyoung Jung, Seoul (KR); Ansun Hyun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 109 days.

(21) Appl. No.: 15/878,270

(22) Filed: Jan. 23, 2018

(65) Prior Publication Data

US 2019/0013584 A1 Jan. 10, 2019

(30) Foreign Application Priority Data

Jul. 5, 2017 (KR) ..... 10-2017-0085553

(51) Int. Cl.

| | |
|---|---|
| ***H01Q 5/35*** | (2015.01) |
| ***H01Q 3/26*** | (2006.01) |
| ***H01Q 1/24*** | (2006.01) |
| ***H01Q 25/00*** | (2006.01) |
| ***H01Q 9/04*** | (2006.01) |
| ***H01Q 21/08*** | (2006.01) |
| ***H01Q 1/22*** | (2006.01) |
| ***H01Q 21/00*** | (2006.01) |

(52) U.S. Cl.

CPC ..... *H01Q 5/35* (2015.01); *H01Q 1/2283* (2013.01); *H01Q 1/243* (2013.01); *H01Q 3/26* (2013.01); *H01Q 9/0485* (2013.01); *H01Q 21/0006* (2013.01); *H01Q 21/08* (2013.01); *H01Q 25/00* (2013.01)

(58) Field of Classification Search

CPC .... H01Q 5/35; H01Q 21/0006; H01Q 1/2283; H01Q 1/243; H01Q 21/08; H01Q 3/26; H01Q 9/0485; H01Q 25/00; H01Q 1/24

USPC ..... 343/893

See application file for complete search history.

(56) References Cited

U.S. PATENT DOCUMENTS

| | | | | |
|---|---|---|---|---|
| 7,119,745 | B2 * | 10/2006 | Gaucher | H01Q 9/26 343/700 MS |
| 2004/0227669 | A1 * | 11/2004 | Okado | H01Q 1/22 343/700 MS |
| 2014/0085163 | A1 * | 3/2014 | Gregg | H01Q 1/12 343/872 |

(Continued)

OTHER PUBLICATIONS

European Patent Office Application Serial No. 18168514.0, Search Report dated Oct. 12, 2018, 11 pages.

(Continued)

*Primary Examiner* — Hai V Tran

(74) *Attorney, Agent, or Firm* — Lee, Hong, Degerman, Kang & Waimey PC

(57) ABSTRACT

An electronic device includes: a body; a circuit board disposed in the body; and an antenna device mounted to one region of the body, and having first and second antenna units spaced apart from each other by a specific interval, in order to transceive a radio signal at a specific frequency band, wherein each of the first and second antenna units includes: a dielectric substance disposed to form a gap with the circuit board; an antenna chip disposed at the circuit board; and a pair of feeding portions for connecting the antenna chip with the dielectric substance.

14 Claims, 9 Drawing Sheets

(56) References Cited

U.S. PATENT DOCUMENTS

| | | | | |
|---|---|---|---|---|
| 2017/0054200 | A1* | 2/2017 | Kang | H01Q 5/35 |
| 2019/0013584 | A1* | 1/2019 | Ryu | H01Q 1/243 |

OTHER PUBLICATIONS

Fang, X. S. et al., "Compact Differential Rectangular Dielectric Resonator Antenna", IEEE Antennas and Wireless Propagation Letters, vol. 9, Jan. 2010, XP011331383, 4 pages.

Balanis, C. A., "Arrays: Linear, Planar, and Circular," Antenna Theory: Analysis Design, Third Edition, John Wiley & Sons, Jan. 2005, XP055512406, 22 pages.

* cited by examiner

ELECTRONIC DEVICE

CROSS-REFERENCE TO RELATED APPLICATION

Pursuant to 35 U.S.C. § 119(a), this application claims the benefit of earlier filing date and right of priority to Korean Patent Application No. 10-2017-0085553, filed on Jul. 5, 2017, the contents of which are hereby incorporated by reference herein in its entirety.

BACKGROUND OF THE INVENTION

1. Field of the Invention

This specification relates to an electronic device including an antenna having a wideband frequency.

2. Background of the Invention

Electronic devices may be generally classified as mobile/portable electronic devices or stationary electronic devices according to their mobility. Electronic devices may also be classified as handheld electronic devices or vehicle mounted electronic devices according to whether or not a user can directly carry the electronic device.

Electronic devices have become increasingly more functional. Examples of such functions include capturing images and video, playing music files or video files, playing games, receiving broadcasts, etc. The electronic devices are configured as multimedia players. Efforts are ongoing to support and increase the functionality of the electronic devices. Such efforts include software and hardware improvements, as well as changes and improvements in the structural components.

Recently, an electronic device requires an antenna of a wideband because each country uses a different frequency band. Further, due to a limited beam scanning range of an antenna device, research to overcome functions and the quality of the antenna device is ongoing. However, there is a problem that a physical space to enhance the quality of an antenna is deficient due to miniaturization of the electronic device.

SUMMARY OF THE INVENTION

Therefore, an aspect of the detailed description is to provide an electronic device including an antenna device for covering a wide frequency band.

To achieve these and other advantages and in accordance with the purpose of this specification, as embodied and broadly described herein, there is provided an electronic device, comprising: a body; a circuit board disposed in the body; and an antenna device mounted to one region of the body, and having first and second antenna units spaced apart from each other by a specific interval, in order to transceive a radio signal at a specific frequency band, wherein each of the first and second antenna units includes: a dielectric substance disposed to form a gap with the circuit board; an antenna chip disposed at the circuit board; and a pair of feeding portions for connecting the antenna chip with the dielectric substance.

In an embodiment, the dielectric substance may include a fixed portion protruded so as to be fixed to the circuit board; and a recess portion which forms a gap with the circuit board.

In an embodiment, since the feeding portions include first and second regions formed to be perpendicular to each other, not only the dielectric substance but also the circuit board may be coupled. This may implement a radio antenna of a wideband.

In the present invention, in case of supplying a power having different phases by the antenna unit including the dielectric substance which forms a specific gap with the circuit board, a radiation pattern such as a YAGI antenna may be formed. This may allow a beam scanning range of the antenna device to be extended up to 180° from 0°.

Further, since the feeding portions include first and second regions formed to be perpendicular to each other, a coupling region may be extended. This may implement a radio antenna of a wideband.

Further, since the dielectric substance is connected to the pair of feeding portions, an effective isotropic radiated power may be increased. This may enhance an antenna efficiency.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1A:
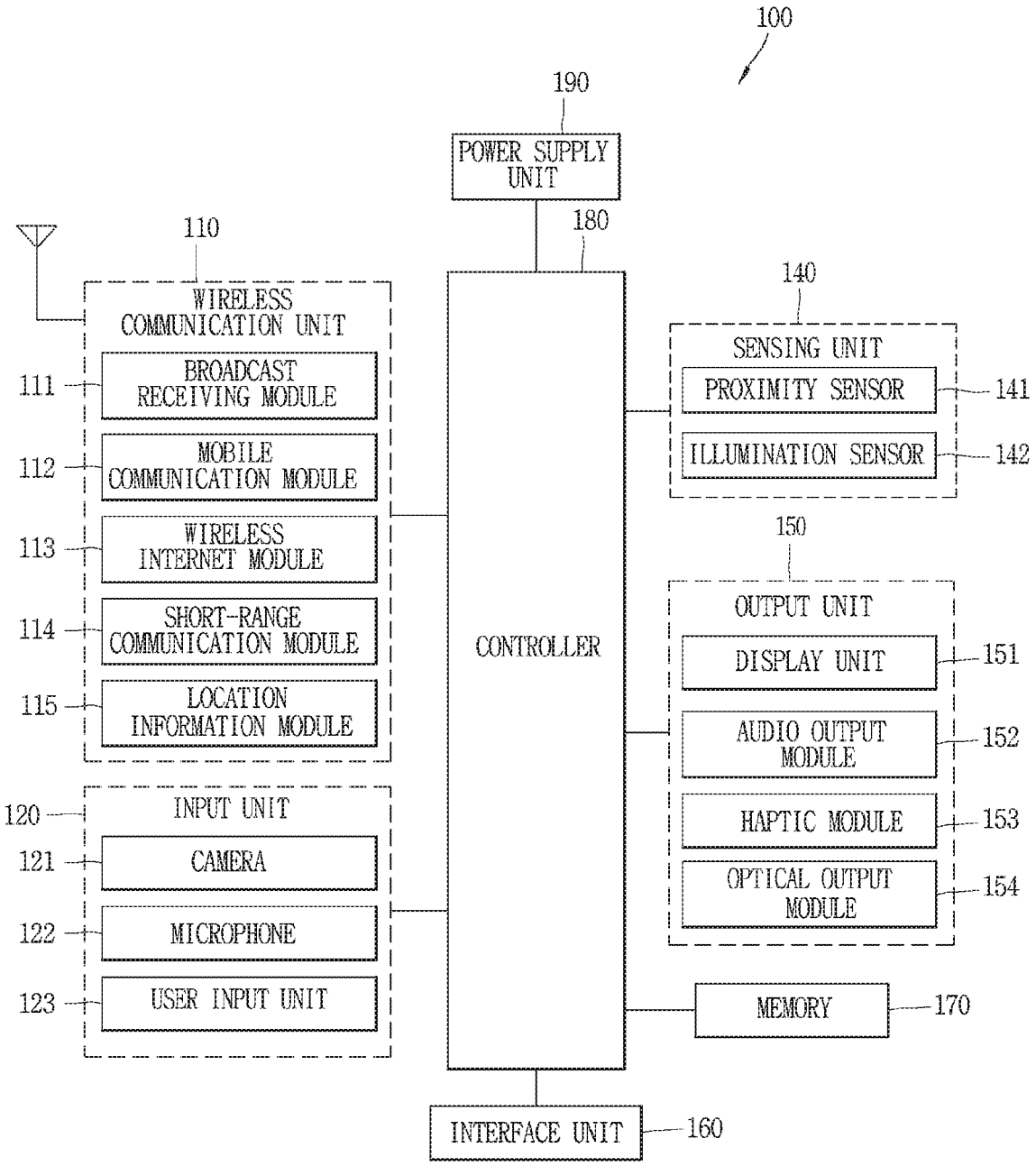
FIG. 1A is a block diagram of an electronic device according to the present invention.

FIG. 1A is a block diagram of an electronic device 100 in accordance with the present disclosure.

The electronic device 100 is shown having components such as a wireless communication unit 110, an input unit 120, a sensing unit 140, an output unit 150, an interface unit 160, a memory 170, a controller 180, and a power supply unit 190. It is understood that implementing all of the components illustrated in FIG. 1 is not a requirement, and that greater or fewer components may alternatively be implemented.

The electronic device 100 is shown having wireless communication unit 110 configured with several commonly implemented components. For instance, the wireless communication unit 110 typically includes one or more components which permit wireless communication between the electronic device 100 and a wireless communication system or network within which the electronic device is located.

The wireless communication unit 110 typically includes one or more modules which permit communications such as wireless communications between the electronic device 100 and a wireless communication system, communications between the electronic device 100 and another electronic device, communications between the electronic device 100 and an external server. Further, the wireless communication unit 110 typically includes one or more modules which connect the electronic device 100 to one or more networks. To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the electronic device, the surrounding environment of the electronic device, user information, and the like. For example, in FIG. 1A, the sensing unit 140 is shown having a proximity sensor 141 and an illumination sensor 142. If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The electronic device 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154.

The display unit 151 may have an inter-layered structure or an integrated structure with a touch sensor in order to facilitate a touch screen. The touch screen may provide an output interface between the electronic device 100 and a user, as well as function as the user input unit 123 which provides an input interface between the electronic device 100 and the user.

The interface unit 160 serves as an interface with various types of external devices that can be coupled to the electronic device 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the electronic device 100 may perform assorted control functions associated with a connected external device, in response to the external device being connected to the interface unit 160.

The memory 170 is typically implemented to store data to support various functions or features of the electronic device 100. For instance, the memory 170 may be configured to store application programs executed in the electronic device 100, data or instructions for operations of the electronic device 100, and the like. Some of these application programs may be downloaded from an external server via wireless communication. Other application programs may be installed within the electronic device 100 at time of manufacturing or shipping, which is typically the case for basic functions of the electronic device 100 (for example, receiving a call, placing a call, receiving a message, sending a message, and the like). It is common for application programs to be stored in the memory 170, installed in the electronic device 100, and executed by the controller 180 to perform an operation (or function) for the electronic device 100.

The controller 180 typically functions to control overall operation of the electronic device 100, in addition to the operations associated with the application programs. The controller 180 may provide or process information or functions appropriate for a user by processing signals, data, information and the like, which are input or output by the various components depicted in FIG. 1A, or activating application programs stored in the memory 170. As one example, the controller 180 controls some or all of the components illustrated in FIGS. 1A-1C according to the execution of an application program that have been stored in the memory 170.

The power supply unit 190 can be configured to receive external power or provide internal power in order to supply appropriate power required for operating elements and components included in the electronic device 100. The power supply unit 190 may include a battery, and the battery may be configured to be embedded in the body, or configured to be detachable from the body.

Referring still to FIG. 1A, various components depicted in this figure will now be described in more detail. Regarding the wireless communication unit 110, the broadcast receiving module 111 is typically configured to receive a broadcast signal and/or broadcast associated information from an external broadcast managing entity via a broadcast channel. The broadcast channel may include a satellite channel, a terrestrial channel, or both. In some embodiments, two or more broadcast receiving modules 111 may be utilized to facilitate simultaneously receiving of two or more broadcast channels, or to support switching among broadcast channels.

The mobile communication module 112 can transmit and/or receive wireless signals to and from one or more network entities. Typical examples of a network entity include a base station, an external electronic device, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like). Examples of wireless signals transmitted and/or received via the mobile communication module 112 include audio call signals, video (telephony) call signals, or various formats of data to support communication of text and multimedia messages.

The wireless Internet module 113 is configured to facilitate wireless Internet access. This module may be internally or externally coupled to the electronic device 100. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like. The wireless Internet module 113 may transmit/receive data according to one or more of such wireless Internet technologies, and other Internet technologies as well.

In some embodiments, when the wireless Internet access is implemented according to, for example, WiBro, HSDPA, HSUPA, GSM, CDMA, WCDMA, LTE, LTE-A and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication module 114 in general supports wireless communications between the electronic device 100 and a wireless communication system, communications between the electronic device 100 and another electronic device 100, or communications between the electronic device and a network where another electronic device 100 (or an external server) is located, via wireless area networks. One example of the wireless area networks is a wireless personal area networks.

In some embodiments, another electronic device (which may be configured similarly to electronic device 100) may be a wearable device, for example, a smart watch, a smart glass or a head mounted display (HMD), which is able to exchange data with the electronic device 100 (or otherwise cooperate with the electronic device 100). The short-range communication module 114 may sense or recognize the wearable device, and permit communication between the wearable device and the electronic device 100. In addition, when the sensed wearable device is a device which is authenticated to communicate with the electronic device 100, the controller 180, for example, may cause transmission of data processed in the electronic device 100 to the wearable device via the short-range communication module 114. Hence, a user of the wearable device may use the data processed in the electronic device 100 on the wearable device. For example, when a call is received in the electronic device 100, the user may answer the call using the wearable device. Also, when a message is received in the electronic device 100, the user can check the received message using the wearable device.

The location information module 115 is generally configured to detect, calculate, derive or otherwise identify a position of the electronic device. As an example, the location information module 115 includes a Global Position System (GPS) module, a Wi-Fi module, or both. If desired, the location information module 115 may alternatively or additionally function with any of the other modules of the wireless communication unit 110 to obtain data related to the position of the electronic device.

As one example, when the electronic device uses a GPS module, a position of the electronic device may be acquired using a signal sent from a GPS satellite. As another example, when the electronic device uses the Wi-Fi module, a position of the electronic device can be acquired based on information related to a wireless access point (AP) which transmits or receives a wireless signal to or from the Wi-Fi module.

The input unit 120 may be configured to permit various types of input to the electronic device 120. Examples of such input include audio, image, video, data, and user input. Image and video input is often obtained using one or more cameras 121. Such cameras 121 may process image frames of still pictures or video obtained by image sensors in a video or image capture mode. The processed image frames can be displayed on the display unit 151 or stored in memory 170. In some cases, the cameras 121 may be arranged in a matrix configuration to permit a plurality of images having various angles or focal points to be input to the electronic device 100. As another example, the cameras 121 may be located in a stereoscopic arrangement to acquire left and right images for implementing a stereoscopic image.

The microphone 122 is generally implemented to permit audio input to the electronic device 100. The audio input can be processed in various manners according to a function being executed in the electronic device 100. If desired, the microphone 122 may include assorted noise removing algorithms to remove unwanted noise generated in the course of receiving the external audio.

The user input unit 123 is a component that permits input by a user. Such user input may enable the controller 180 to control operation of the electronic device 100. The user input unit 123 may include one or more of a mechanical input element (for example, a key, a button located on a front and/or rear surface or a side surface of the electronic device 100, a dome switch, a jog wheel, a jog switch, and the like), or a touch-sensitive input, among others. As one example, the touch-sensitive input may be a virtual key or a soft key, which is displayed on a touch screen through software processing, or a touch key which is located on the electronic device at a location that is other than the touch screen. On the other hand, the virtual key or the visual key may be displayed on the touch screen in various shapes, for example, graphic, text, icon, video, or a combination thereof.

The sensing unit 140 is generally configured to sense one or more of internal information of the electronic device, surrounding environment information of the electronic device, user information, or the like. The controller 180 generally cooperates with the sending unit 140 to control operation of the electronic device 100 or execute data processing, a function or an operation associated with an application program installed in the electronic device based on the sensing provided by the sensing unit 140. The sensing unit 140 may be implemented using any of a variety of sensors, some of which will now be described in more detail.

The proximity sensor 141 may include a sensor to sense presence or absence of an object approaching a surface, or an object located near a surface, by using an electromagnetic field, infrared rays, or the like without a mechanical contact. The proximity sensor 141 may be arranged at an inner region of the electronic device covered by the touch screen, or near the touch screen.

The proximity sensor 141, for example, may include any of a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and the like. When the touch screen is implemented as a capacitance type, the proximity sensor 141 can sense proximity of a pointer relative to the touch screen by changes of an electromagnetic field, which is responsive to an approach of an object with conductivity. In this case, the touch screen (touch sensor) may also be categorized as a proximity sensor.

The term "proximity touch" will often be referred to herein to denote the scenario in which a pointer is positioned to be proximate to the touch screen without contacting the touch screen. The term "contact touch" will often be referred to herein to denote the scenario in which a pointer makes physical contact with the touch screen. For the position corresponding to the proximity touch of the pointer relative to the touch screen, such position will correspond to a position where the pointer is perpendicular to the touch screen. The proximity sensor 141 may sense proximity touch, and proximity touch patterns (for example, distance, direction, speed, time, position, moving status, and the like).

In general, controller 180 processes data corresponding to proximity touches and proximity touch patterns sensed by the proximity sensor 141, and cause output of visual information on the touch screen. In addition, the controller 180 can control the electronic device 100 to execute different operations or process different data according to whether a touch with respect to a point on the touch screen is either a proximity touch or a contact touch.

A touch sensor can sense a touch applied to the touch screen, such as display unit 151, using any of a variety of touch methods. Examples of such touch methods include a resistive type, a capacitive type, an infrared type, and a magnetic field type, among others.

As one example, the touch sensor may be configured to convert changes of pressure applied to a specific part of the display unit 151, or convert capacitance occurring at a specific part of the display unit 151, into electric input signals. The touch sensor may also be configured to sense not only a touched position and a touched area, but also touch pressure and/or touch capacitance. A touch object is generally used to apply a touch input to the touch sensor. Examples of typical touch objects include a finger, a touch pen, a stylus pen, a pointer, or the like.

When a touch input is sensed by a touch sensor, corresponding signals may be transmitted to a touch controller. The touch controller may process the received signals, and then transmit corresponding data to the controller 180. Accordingly, the controller 180 may sense which region of the display unit 151 has been touched. Here, the touch controller may be a component separate from the controller 180, the controller 180, and combinations thereof.

In some embodiments, the controller 180 may execute the same or different controls according to a type of touch object that touches the touch screen or a touch key provided in addition to the touch screen. Whether to execute the same or different control according to the object which provides a touch input may be decided based on a current operating state of the electronic device 100 or a currently executed application program, for example.

The touch sensor and the proximity sensor may be implemented individually, or in combination, to sense various types of touches. Such touches includes a short (or tap) touch, a long touch, a multi-touch, a drag touch, a flick touch, a pinch-in touch, a pinch-out touch, a swipe touch, a hovering touch, and the like.

If desired, an ultrasonic sensor may be implemented to recognize position information relating to a touch object using ultrasonic waves. The controller 180, for example, may calculate a position of a wave generation source based on information sensed by an illumination sensor and a plurality of ultrasonic sensors. Since light is much faster than ultrasonic waves, the time for which the light reaches the optical sensor is much shorter than the time for which the ultrasonic wave reaches the ultrasonic sensor. The position of the wave generation source may be calculated using this fact. For instance, the position of the wave generation source may be calculated using the time difference from the time that the ultrasonic wave reaches the sensor based on the light as a reference signal.

The camera 121 typically includes at least one a camera sensor (CCD, CMOS etc.), a photo sensor (or image sensors), and a laser sensor.

Implementing the camera 121 with a laser sensor may allow detection of a touch of a physical object with respect to a 3D stereoscopic image. The photo sensor may be laminated on, or overlapped with, the display device. The photo sensor may be configured to scan movement of the physical object in proximity to the touch screen. In more detail, the photo sensor may include photo diodes and transistors at rows and columns to scan content received at the photo sensor using an electrical signal which changes according to the quantity of applied light. Namely, the photo sensor may calculate the coordinates of the physical object according to variation of light to thus obtain position information of the physical object.

The display unit 151 is generally configured to output information processed in the electronic device 100. For example, the display unit 151 may display execution screen information of an application program executing at the electronic device 100 or user interface (UI) and graphic user interface (GUI) information in response to the execution screen information.

In some embodiments, the display unit 151 may be implemented as a stereoscopic display unit for displaying stereoscopic images. A typical stereoscopic display unit may employ a stereoscopic display scheme such as a stereoscopic scheme (a glass scheme), an auto-stereoscopic scheme (glassless scheme), a projection scheme (holographic scheme), or the like.

The audio output module 152 is generally configured to output audio data. Such audio data may be obtained from any of a number of different sources, such that the audio data may be received from the wireless communication unit 110 or may have been stored in the memory 170. The audio data may be output during modes such as a signal reception mode, a call mode, a record mode, a voice recognition mode, a broadcast reception mode, and the like. The audio output module 152 can provide audible output related to a particular function (e.g., a call signal reception sound, a message reception sound, etc.) performed by the electronic device 100. The audio output module 152 may also be implemented as a receiver, a speaker, a buzzer, or the like.

A haptic module 153 can be configured to generate various tactile effects that a user feels, perceive, or otherwise experience. A typical example of a tactile effect generated by the haptic module 153 is vibration. The strength, pattern and the like of the vibration generated by the haptic module 153 can be controlled by user selection or setting by the controller. For example, the haptic module 153 may output different vibrations in a combining manner or a sequential manner.

Besides vibration, the haptic module 153 can generate various other tactile effects, including an effect by stimulation such as a pin arrangement vertically moving to contact skin, a spray force or suction force of air through a jet orifice or a suction opening, a touch to the skin, a contact of an electrode, electrostatic force, an effect by reproducing the sense of cold and warmth using an element that can absorb or generate heat, and the like.

The haptic module 153 can also be implemented to allow the user to feel a tactile effect through a muscle sensation such as the user's fingers or arm, as well as transferring the tactile effect through direct contact. Two or more haptic modules 153 may be provided according to the particular configuration of the electronic device 100.

An optical output module 154 can output a signal for indicating an event generation using light of a light source. Examples of events generated in the electronic device 100 may include message reception, call signal reception, a missed call, an alarm, a schedule notice, an email reception, information reception through an application, and the like.

A signal output by the optical output module 154 may be implemented in such a manner that the electronic device emits monochromatic light or light with a plurality of colors. The signal output may be terminated as the electronic device senses that a user has checked the generated event, for example.

The interface unit 160 serves as an interface for external devices to be connected with the electronic device 100. For example, the interface unit 160 can receive data transmitted from an external device, receive power to transfer to elements and components within the electronic device 100, or transmit internal data of the electronic device 100 to such external device. The interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the electronic device 100 and may include a user identity module (UIM), a subscriber identity module (SIM), a universal subscriber identity module (USIM), and the like. In addition, the device having the identification module (also referred to herein as an "identifying device") may take the form of a smart card. Accordingly, the identifying device can be connected with the electronic device 100 via the interface unit 160.

When the electronic device 100 is connected with an external cradle, the interface unit 160 can serve as a passage to allow power from the cradle to be supplied to the electronic device 100 or may serve as a passage to allow various command signals input by the user from the cradle to be transferred to the electronic device there through. Various command signals or power input from the cradle may operate as signals for recognizing that the electronic device is properly mounted on the cradle.

The memory 170 can store programs to support operations of the controller 180 and store input/output data (for example, phonebook, messages, still images, videos, etc.). The memory 170 may store data related to various patterns of vibrations and audio which are output in response to touch inputs on the touch screen.

The memory 170 may include one or more types of storage mediums including a Flash memory, a hard disk, a solid state disk, a silicon disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like. The electronic device 100 may also be operated in relation to a network storage device that performs the storage function of the memory 170 over a network, such as the Internet.

The controller 180 may typically control the general operations of the electronic device 100. For example, the controller 180 may set or release a lock state for restricting a user from inputting a control command with respect to applications when a status of the electronic device meets a preset condition.

The controller 180 can also perform the controlling and processing associated with voice calls, data communications, video calls, and the like, or perform pattern recognition processing to recognize a handwriting input or a picture drawing input performed on the touch screen as characters or images, respectively. In addition, the controller 180 can control one or a combination of those components in order to implement various exemplary embodiments disclosed herein.

The power supply unit 190 receives external power or provide internal power and supply the appropriate power required for operating respective elements and components included in the electronic device 100. The power supply unit 190 may include a battery, which is typically rechargeable or be detachably coupled to the body for charging.

The power supply unit 190 may include a connection port. The connection port may be configured as one example of the interface unit 160 to which an external charger for supplying power to recharge the battery is electrically connected.

As another example, the power supply unit 190 may be configured to recharge the battery in a wireless manner without use of the connection port. In this example, the power supply unit 190 can receive power, transferred from an external wireless power transmitter, using at least one of an inductive coupling method which is based on magnetic induction or a magnetic resonance coupling method which is based on electromagnetic resonance.

Various embodiments described herein may be implemented in a computer-readable medium, a machine-readable medium, or similar medium using, for example, software, hardware, or any combination thereof.

Figure 1B:
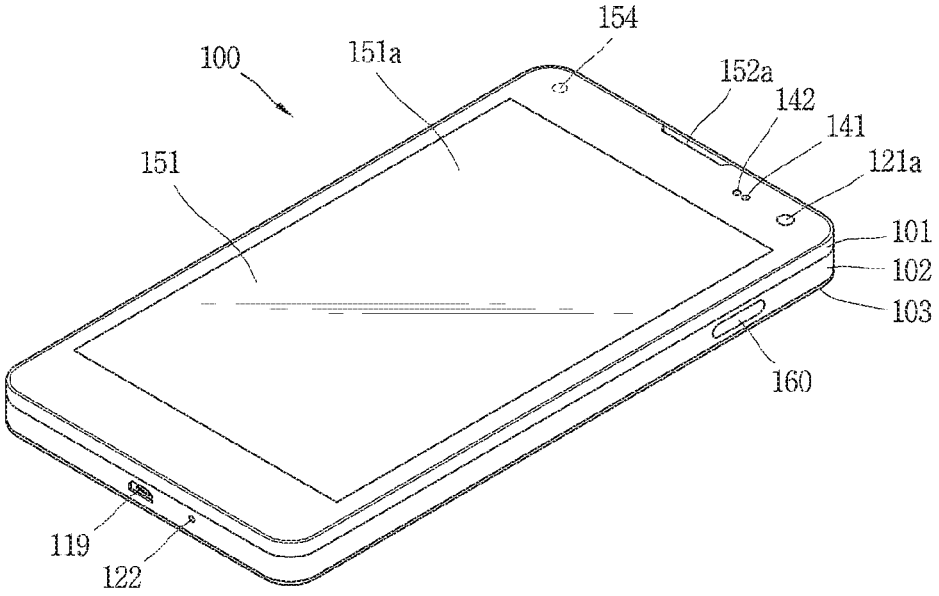
FIGS. 1B and 1C are conceptual views illustrating an example of an electronic device according to the present invention, which are viewed from different directions.
Figure 1C:
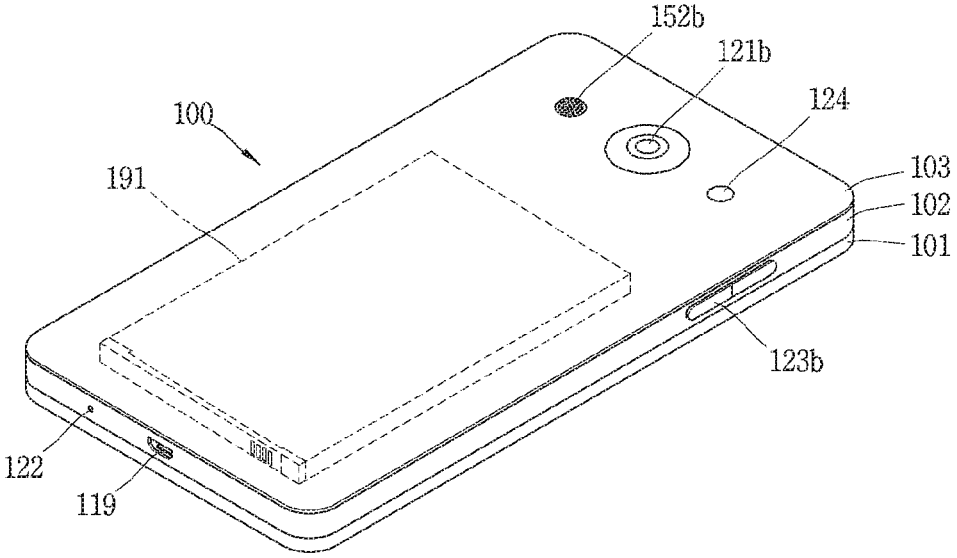

Referring now to FIGS. 1B and 1C, the electronic device 100 is described with reference to a bar-type device body. However, the electronic device 100 may alternatively be implemented in any of a variety of different configurations. Examples of such configurations include watch-type, cliptype, glasses-type, or as a folder-type, flip-type, slide-type, swing-type, and swivel-type in which two and more bodies are combined with each other in a relatively movable manner, and combinations thereof. Discussion herein will often relate to a particular type of electronic device (for example, bar-type, watch-type, glasses-type, and the like). However, such teachings with regard to a particular type of electronic device will generally apply to other types of electronic devices as well.

The electronic device 100 will generally include a case (for example, frame, housing, cover, and the like) forming the appearance of the electronic device. In this embodiment, the case is formed using a front case 101 and a rear case 102. Various electronic components are incorporated into a space formed between the front case 101 and the rear case 102. At least one middle case may be additionally positioned between the front case 101 and the rear case 102.

The display unit 151 is shown located on the front side of the device body to output information. As illustrated, a window 151*a* of the display unit 151 may be mounted to the front case 101 to form the front surface of the device body together with the front case 101.

In some embodiments, electronic components may also be mounted to the rear case 102. Examples of such electronic components include a detachable battery 191, an identification module, a memory card, and the like. Rear cover 103 is shown covering the electronic components, and this cover may be detachably coupled to the rear case 102. Therefore, when the rear cover 103 is detached from the rear case 102, the electronic components mounted to the rear case 102 are externally exposed.

As illustrated, when the rear cover 103 is coupled to the rear case 102, a side surface of the rear case 102 is partially exposed. In some cases, upon the coupling, the rear case 102 may also be completely shielded by the rear cover 103. In some embodiments, the rear cover 103 may include an opening for externally exposing a camera 121*b* or an audio output module 152*b*.

The cases 101, 102, 103 may be formed by injection-molding synthetic resin or may be formed of a metal, for example, stainless steel (STS), aluminum (Al), titanium (Ti), or the like.

As an alternative to the example in which the plurality of cases form an inner space for accommodating components, the electronic device 100 may be configured such that one case forms the inner space. In this example, an electronic device 100 having a uni-body is formed in such a manner that synthetic resin or metal extends from a side surface to a rear surface.

If desired, the electronic device 100 may include a waterproofing unit (not shown) for preventing introduction of water into the device body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

FIGS. 1B and 1C depict certain components as arranged on the electronic device. However, it is to be understood that alternative arrangements are possible and within the teachings of the instant disclosure. Some components may be omitted or rearranged. For example, the first manipulation unit 123*a* may be located on another surface of the device body, and the second audio output module 152*b* may be located on the side surface of the device body.

The display unit 151 is generally configured to output information processed in the electronic device 100. For example, the display unit 151 may display execution screen information of an application program executing at the electronic device 100 or user interface (UI) and graphic user interface (GUI) information in response to the execution screen information.

The display unit 151 outputs information processed in the electronic device 100. The display unit 151 may be implemented using one or more suitable display devices. Examples of such suitable display devices include a liquid crystal display (LCD), a thin film transistor-liquid crystal display (TFT-LCD), an organic light emitting diode (OLED), a flexible display, a 3-dimensional (3D) display, an e-ink display, and combinations thereof.

The display unit 151 may be implemented using two display devices, which can implement the same or different display technology. For instance, a plurality of the display units 151 may be arranged on one side, either spaced apart from each other, or these devices may be integrated, or these devices may be arranged on different surfaces.

The display unit 151 may also include a touch sensor which senses a touch input received at the display unit. When a touch is input to the display unit 151, the touch sensor may be configured to sense this touch and the controller 180, for example, may generate a control command or other signal corresponding to the touch. The content which is input in the touching manner may be a text or numerical value, or a menu item which can be indicated or designated in various modes.

The touch sensor may be configured in a form of a film having a touch pattern, disposed between the window 151*a* and a display on a rear surface of the window 151*a*, or a metal wire which is patterned directly on the rear surface of the window 151*a*. Alternatively, the touch sensor may be integrally formed with the display. For example, the touch sensor may be disposed on a substrate of the display or within the display.

The display unit 151 may also form a touch screen together with the touch sensor. Here, the touch screen may serve as a user input unit. Therefore, the touch screen may replace at least some of the functions of the first manipulation unit 123*a*. Hereinafter, for convenience, the display unit (display module) for outputting an image and the touch sensor will be referred to as the touch screen 151.

The first audio output module 152*a* may be implemented in the form of a speaker to output voice audio, alarm sounds, multimedia audio reproduction, and the like.

The window 151*a* of the display unit 151 will typically include an aperture to permit audio generated by the first audio output module 152*a* to pass. One alternative is to allow audio to be released along an assembly gap between the structural bodies (for example, a gap between the window 151*a* and the front case 101). In this case, a hole independently formed to output audio sounds may not be seen or is otherwise hidden in terms of appearance, thereby further simplifying the appearance and manufacturing of the electronic device 100.

The optical output module 154 can be configured to output light for indicating an event generation. Examples of such events include a message reception, a call signal reception, a missed call, an alarm, a schedule notice, an email reception, information reception through an application, and the like. When a user has checked a generated event, the controller can control the optical output unit 154 to stop the light output.

The first camera 121*a* can process image frames such as still or moving images obtained by the image sensor in a capture mode or a video call mode. The processed image frames can then be displayed on the display unit 151 or stored in the memory 170.

The first and second manipulation units 123*a* and 123*b* are examples of the user input unit 123, which may be manipulated by a user to provide input to the electronic device 100. The first and second manipulation units 123*a* and 123*b* may also be commonly referred to as a manipulating portion, and may employ any tactile method that allows the user to perform manipulation such as touch, push, scroll, or the like. The first and second manipulation units 123*a* and 123*b* may also employ any non-tactile method that allows the user to perform manipulation such as proximity touch, hovering, or the like.

FIGS. 1A and 1B illustrate the first manipulation unit 123*a* as a touch key, but possible alternatives include a mechanical key, a push key, a touch key, and combinations thereof.

Input received at the first and second manipulation units 123*a* and 123*b* may be used in various ways. For example, the first manipulation unit 123*a* may be used by the user to provide an input to a menu, home key, cancel, search, or the like, and the second manipulation unit 123*b* may be used by the user to provide an input to control a volume level being output from the first or second audio output modules 152*a* or 152*b*, to switch to a touch recognition mode of the display unit 151, or the like.

As another example of the user input unit 123, a rear input unit (not shown) may be located on the rear surface of the device body. The rear input unit can be manipulated by a user to provide input to the electronic device 100. The input may be used in a variety of different ways. For example, the rear input unit may be used by the user to provide an input for power on/off, start, end, scroll, control volume level being output from the first or second audio output modules 152*a* or 152*b*, switch to a touch recognition mode of the display unit 151, and the like. The rear input unit may be configured to permit touch input, a push input, or combinations thereof.

The rear input unit may be located to overlap the display unit 151 of the front side in a thickness direction of the device body. As one example, the rear input unit may be located on an upper end portion of the rear side of the device body such that a user can easily manipulate it using a forefinger when the user grabs the device body with one hand. Alternatively, the rear input unit can be positioned at most any location of the rear side of the device body.

Embodiments that include the rear input unit may implement some or all of the functionality of the first manipulation unit 123*a* in the rear input unit. As such, in situations where the first manipulation unit 123*a* is omitted from the front side, the display unit 151 can have a larger screen.

As a further alternative, the electronic device 100 may include a finger scan sensor which scans a user's fingerprint. The controller 180 can then use fingerprint information sensed by the finger scan sensor as part of an authentication procedure. The finger scan sensor may also be installed in the display unit 151 or implemented in the user input unit 123.

The microphone 122 is shown located at an end of the electronic device 100, but other locations are possible. If desired, multiple microphones may be implemented, with such an arrangement permitting the receiving of stereo sounds.

The interface unit 160 may serve as a path allowing the electronic device 100 to interface with external devices. For example, the interface unit 160 may include one or more of a connection terminal for connecting to another device (for example, an earphone, an external speaker, or the like), a port for near field communication (for example, an Infrared Data Association (IrDA) port, a Bluetooth port, a wireless LAN port, and the like), or a power supply terminal for supplying power to the electronic device 100. The interface unit 160 may be implemented in the form of a socket for accommodating an external card, such as Subscriber Identification Module (SIM), User Identity Module (UIM), or a memory card for information storage.

The second camera 121*b* is shown located at the rear side of the device body and includes an image capturing direction that is substantially opposite to the image capturing direction of the first camera unit 121*a*. If desired, second camera 121*a* may alternatively be located at other locations, or made to be moveable, in order to have a different image capturing direction from that which is shown.

The second camera 121*b* can include a plurality of lenses arranged along at least one line. The plurality of lenses may also be arranged in a matrix configuration. The cameras may be referred to as an "array camera." When the second camera 121*b* is implemented as an array camera, images may be captured in various manners using the plurality of lenses and images with better qualities.

A flash 124 is shown adjacent to the second camera 121*b*. When an image of a subject is captured with the camera 121*b*, the flash 124 may illuminate the subject. The second audio output module 152*b* can be located on the device body. The second audio output module 152*b* may implement stereophonic sound functions in conjunction with the first audio output module 152*a*, and may be also used for implementing a speaker phone mode for call communication.

At least one antenna for wireless communication may be located on the device body. The antenna may be installed in the device body or formed by the case. For example, an antenna which configures a part of the broadcast receiving module 111 may be retractable into the device body. Alternatively, an antenna may be formed using a film attached to an inner surface of the rear cover 103, or a case that includes a conductive material.

A power supply unit 190 for supplying power to the electronic device 100 (refer to FIG. 1A) may include a battery 191, which is mounted in the device body or detachably coupled to an outside of the device body.

The battery 191 may receive power via a power source cable connected to the interface unit 160. Also, the battery 191 can be recharged in a wireless manner using a wireless charger. Wireless charging may be implemented by magnetic induction or electromagnetic resonance.

The rear cover 103 is shown coupled to the rear case 102 for shielding the battery 191, to prevent separation of the battery 191, and to protect the battery 191 from an external impact or from foreign material. When the battery 191 is detachable from the device body, the rear case 103 may be detachably coupled to the rear case 102.

An accessory for protecting an appearance or assisting or extending the functions of the electronic device 100 can also be provided on the electronic device 100. As one example of an accessory, a cover or pouch for covering or accommodating at least one surface of the electronic device 100 may be provided. The cover or pouch may cooperate with the display unit 151 to extend the function of the electronic device 100. Another example of the accessory is a touch pen for assisting or extending a touch input to a touch screen.

An embodiment of the present invention relates to the electronic device 100 having a 5G ($5^{th}$ generation) antenna, without lowering performance of a 4G (4th-generation) antenna provided at a body of the electronic device.

A frequency less than 2 GHz is mainly used in 4G mobile communications, and an extreme band frequency about 28 GHz is used in 5G mobile communications unlike 4G LTE. A low band frequency has a wide coverage due to a long wavelength, but communications using a low band frequency has a low transmission speed due to a relatively narrow bandwidth. On the other hand, a high band frequency has a narrow coverage due to a short wavelength, but communications using a high band frequency has a high transmission speed due to a relatively wide bandwidth. Further, communications using a high band frequency may solve a coverage restriction to some degree, by using a characteristic of a linear wave propagation, an array antenna, etc. Thus, 5G mobile communication may increase the conventional small capacity, and may provide various communication services, a mobile internet technique and a machine to machine (M2M) technique to a user.

If a metallic material is used to radiate an antenna for 5G mobile communications, performance of the conventional antenna for 4G mobile communications may be lowered. For instance, an optimum position of a 5G antenna array system may be overlapped with that of a 4G MIMO (multi input multi output) antenna. In this case, performance of the 4G antenna may be lowered by about 4~5 dB. In order to prevent this, the electronic device 100 had to be manufactured to have a large size.

Generally, necessary information cannot be received in all directions, because a beam pattern of a 5G antenna array system is formed to have an angle of −60°~+60°. In order to solve such a problem, the number of 5G chips 132 had to be increased to 3~4, and the plurality of chips 132 had to be mounted in the mobile terminal 100 in a spaced state from each other.

In order to solve such a problem, in an embodiment of the present invention, a 5G antenna is configured as a dielectric substance array.

Figure 2:
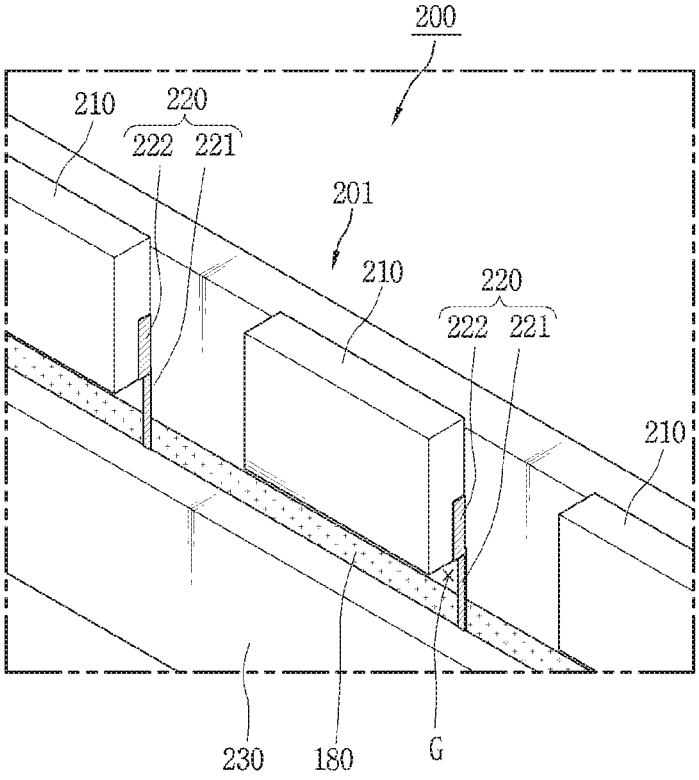
FIG. 2 is a conceptual view for explaining an antenna device according to an embodiment of the present invention.

FIG. 2 is a conceptual view for explaining an antenna device according to an embodiment of the present invention.

Referring to FIG. 2, the antenna device 200 is arranged on a circuit board 180, and the antenna device 200 is provided with dielectric substances 210 and feeding portions 220.

The antenna device 200 which implements a resonant frequency of a frequency band for 5G mobile communications according to this embodiment may be an ultrahigh frequency (mmWave) band. The antenna device 200 uses a nonmetallic dielectric substance as a resonator, thereby not influencing on performance of an antenna for 4G mobile communications. Since the dielectric substance provided at the antenna device according to the present invention is operated as a resonator, the dielectric substance may be referred to as a dielectric resonator. And the antenna device may be referred to as a dielectric resonator antenna (DRA).

The dielectric substance included in the antenna device 200 may have a cylindrical shape, a polygonal shape or a conical shape. Alternatively, the dielectric substance may be formed as two or more cylinders are laminated on each other. The dielectric substance may have any shape, and preferably has a rectangular parallelepiped shape.

As the dielectric substance 210 included in the antenna device 200, preferably used is a dielectric substance having a dielectric constant of about 4~140 and having a low loss tangent. However, a dielectric substance having a dielectric constant of about 6~10 may be used for low cost.

The dielectric substance 210 is arranged on the circuit board 180, and may be connected to a ground portion of the circuit board 180. The structure to fix the dielectric substance 210 to the circuit board 180 is not limited to the one shown in the drawing. The dielectric substance 210 may be fixed to the circuit board 180 by an SMT method or a soldering method, or may be attached to the circuit board 180 by an adhesive member.

A gap (G) is formed between the ground portion of the circuit board 180 and the dielectric substance 210. The gap (G) may be formed only at a partial region between the ground portion of the circuit board 180 and the dielectric substance 210.

An antenna chip 230 is provided in the circuit board 180, and the antenna chip is connected to the dielectric substance 210 by a feeding portion 220. As shown in FIG. 2, the feeding portion 220 has a strip patch type, and may be connected to the dielectric substance 210. The strip patch type corresponds to a case that the feeding portion 220 extended from the antenna chip 230 is disposed to contact the surface of the dielectric substance 210.

However, the present invention is not limited to this. The feeding portion 220 has a via type, and may connect the antenna chip 230 with the dielectric substance 210. The via type corresponds to a case that a via hole is formed in the dielectric substance 210, and the feeding portion 220 extended from the antenna chip 230 is inserted into the dielectric substance 210.

The feeding portion 220 according to the present invention includes a first region 221 and a second region 222. The first region 221 is extended from the antenna chip 230 of the circuit board 180, and the second region 222 is extended from the end of the first region 221 to thus be fixed to one surface of the dielectric substance 210. The first and second regions 221, 222 are formed to have a plate shape, and are arranged to have a specific angle (a right angle) therebetween. That is, if the first region 221 is extended from one surface of the circuit board 180, the second region 222 is formed at one surface of the dielectric substance 210 crossing the circuit board 180. The first and second regions 221, 222 are formed such that at least parts thereof contact different surfaces of the dielectric substance 210.

Not only the dielectric substance 210, but also the circuit board 180 may radiate by the feeding portion 220 including the first and second regions 221, 222 arranged to be perpendicular to each other. As a coupling amount for radiating the dielectric substance 210 and a coupling amount for radiating the circuit board 180 and the dielectric substance 210 are controlled by the first and second regions 221, 222, the circuit board 180 of a specific bandwidth (an ultra wideband "5G") may also radiate. Thus, a specific bandwidth of the antenna device 200 may be obtained.

The dielectric substance has a specific size such that the antenna device 200 obtains a specific bandwidth (e.g., 25 GHz). Further, a shape and a size of the first and second regions 221, 222 may be controlled in order to obtain the specific bandwidth.

The antenna device 200 includes a plurality of antenna units including the dielectric substance 210 and the feeding portion 220 (first and second antenna units 201, 202 in FIG. 2). And the antenna device 200 has first and second modes which form radiation patterns in different directions according to a phase difference of a power supplied to the first and second antenna units 201, 202. The first and second antenna units 201, 202 are spaced from each other by a specific distance. The first and second antenna units 201, 202 are spaced from each other to have a band of first and second frequencies (about 28 GHz and about 39 GHz). For instance, a distance between the first and second antenna units 201, 202 may be set as about 3.85 mm~5.36 mm.

Figure 3A:
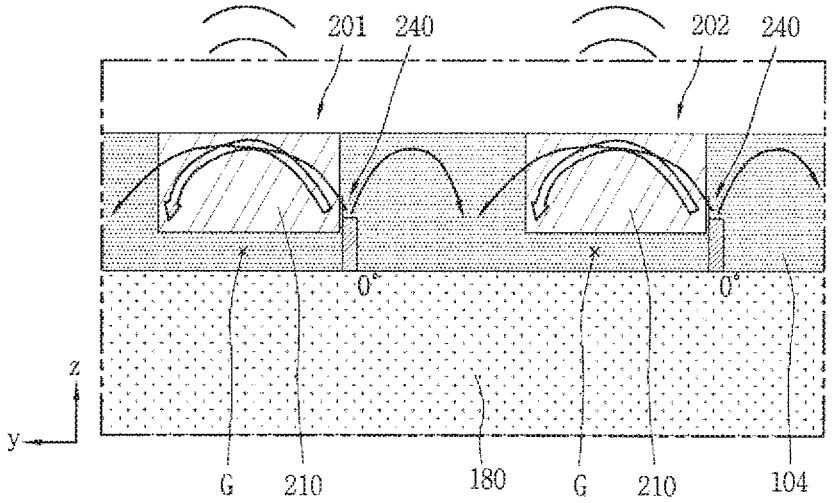
FIG. 3A is a conceptual view for explaining a radiation pattern induced in a first mode.
Figure 3B:
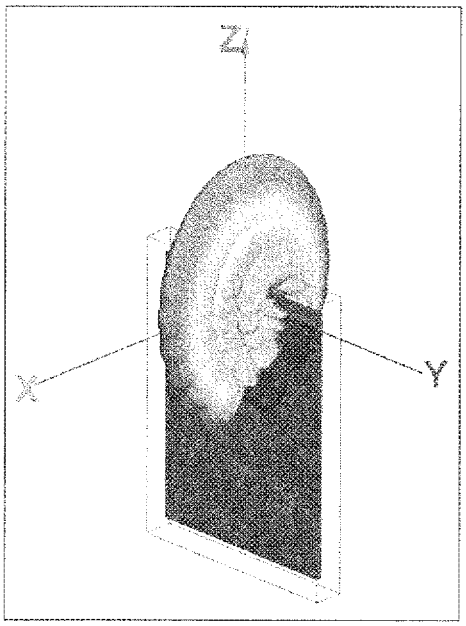
FIG. 3B is a view for explaining a direction of the radiation pattern in the first mode.

FIG. 3A is a conceptual view for explaining a radiation pattern induced in a first mode, and FIG. 3B is a view for explaining a direction of the radiation pattern in the first mode.

Referring to FIGS. 3A and 3B, if a power is supplied to the first and second antenna units 202, 202 in a first mode with the same phase, a radiation pattern is formed towards a Z-axis direction.

If a power is supplied to the first and second antenna units 201, 202 without a phase difference, a radiation pattern is formed from the dielectric substances 210 of the first and second antenna units 201, 202. The radiation pattern is formed in a direction which becomes distant from the circuit board 180.

Referring to FIG. 2B, if the antenna device 200 is disposed above or below the electronic device 100, a radiation pattern is formed towards the upper or lower direction.

Figure 4A:
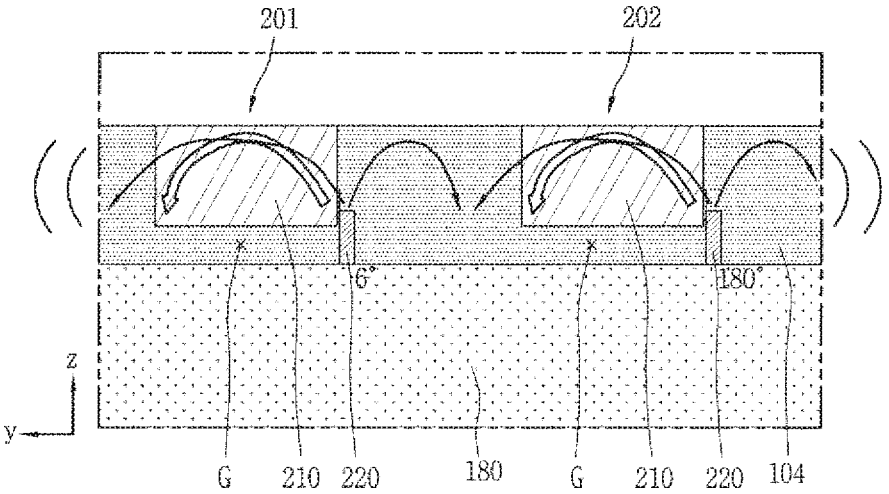
FIG. 4A is a conceptual view for explaining a radiation pattern induced in a second mode.
Figure 4B:
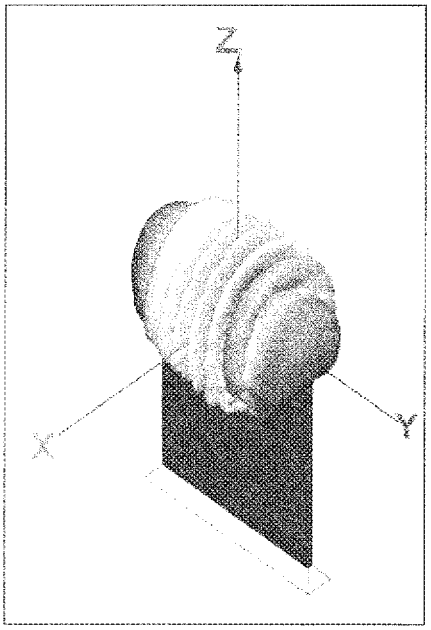
FIG. 4B is a view for explaining a direction of the radiation pattern in the second mode.

FIG. 4A is a conceptual view for explaining a radiation pattern induced in a second mode, and FIG. 4B is a view for explaining a direction of the radiation pattern in the second mode.

The antenna device 200 includes first and second antenna units 201, 202 to which a power is supplied to have a phase difference. The antenna units 201, 202 are arranged in parallel on the basis of the end of the circuit board 180. And dielectric substances 210 of the first and second antenna units 201, 202 are arranged to have a specific separation distance therebetween.

Once a power having a phase difference of 180° is input to the first and second antenna units 201, 202, the antenna device radiates in opposite directions. Thus, radiation in the Z-axis direction is attenuated. As a result, a radiation pattern induced in two directions is formed along a Y-axis direction. That is, the antenna device 200 forms a radiation pattern such as a YAGI antenna in the second mode. The Y-axis direction corresponds to a direction that the first and second antenna units 201, 202 are arranged in parallel, i.e., a direction parallel to the circuit board.

The dielectric substance 210 preferably has a width of about 0.25λ~0.35λ for a radiation pattern towards the Y-axis direction.

Referring to FIGS. 3A and 4A, a radiation pattern is formed in a first mode at about 0°~40° on the basis of the Z-axis, and a radiation pattern is formed in a mixed mode of first and second modes at about 40°~60°. And a radiation pattern is formed in a director mode of the second mode at about 60°~90°, in the same manner as a Yagi antenna.

In the present invention, as the dielectric substances 210 of the first and second antenna units 201, 202 form gaps (G) from the ground portion, a beam scanning can be performed up to about 90°.

Figure 5A:
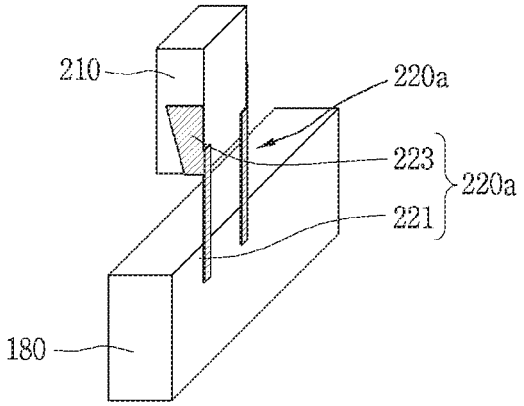
FIGS. 5A, 5B, and 5C are conceptual views for explaining antenna units according to another embodiment of the present invention.
Figure 5B:
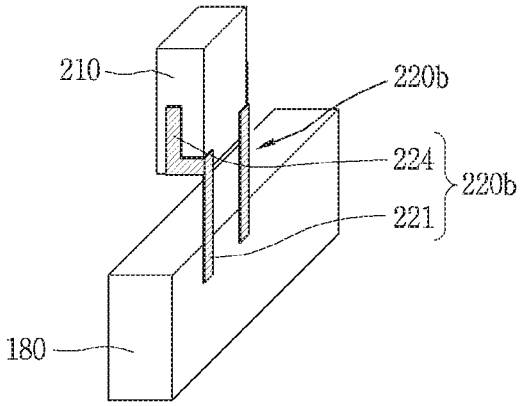
Figure 5C:
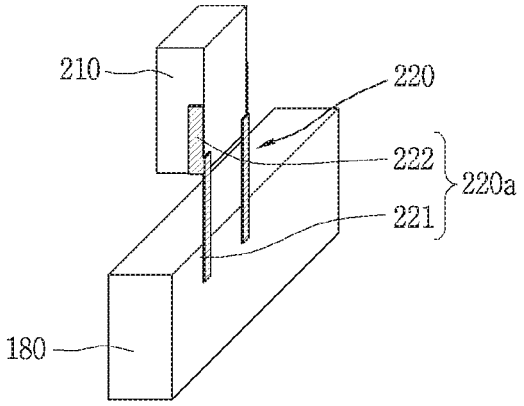

FIGS. 5A to 5C are conceptual views for explaining an antenna unit according to another embodiment of the present invention.

An antenna unit 200 includes a dielectric substance 210 mounted to a circuit board 180, and includes a pair of feeding portions 220*a*. The pair of feeding portions 220*a* are connected to facing surfaces of the dielectric substance 210. The pair of feeding portions 220*a* are arranged to face each other.

If the antenna chip 230 is connected to the dielectric substance 210 by the pair of feeding portions 220*a*, an effective isotropic radiated power of the antenna device 200 is enhanced. If the effective isotropic radiated power of the antenna device 200 is enhanced, power consumption for implementing the same transmission power may be reduced.

Referring to FIG. 5A, the feeding portions 220*a* includes a first region 221 and a second region 223. The first region 221 is extended from the circuit board 180, and the second region 223 is extended from the end of the first region 221. The first and second regions 221, 223 may be formed as plates arranged to be perpendicular to each other. The second region 223 may have a trapezoid shape.

Referring to FIG. 5B, the feeding portion 220*b* includes a first region 221, and a third region 224 extended from the first region 221. The third region 224 may have a different shape from the second region 223, and the third region 224 may have a 'ㄴ' shape.

The shape of one region of the feeding portion 220*b* extended from the first region 221 and attached to the dielectric substance 210 is not limited to the one shown in the drawing, but may be changed according to a coupling amount.

Referring to FIG. 5C, a pair of feeding portions 220 includes first and second regions 221, 222. The first region 221 is extended from the circuit board 180, and the second region 222 is extended from the end of the first region 221. The first and second regions 221, 222 may be formed as quadrangular plates extended in the same direction.

Figure 6A:
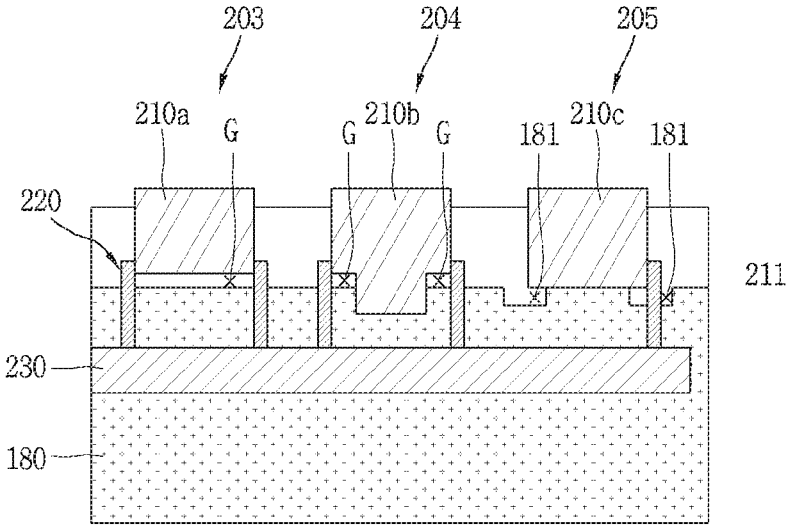
FIGS. 6A, 6B, and 6C are conceptual views for explaining an antenna device including a gap between a dielectric substance and a circuit board.
Figure 6B:
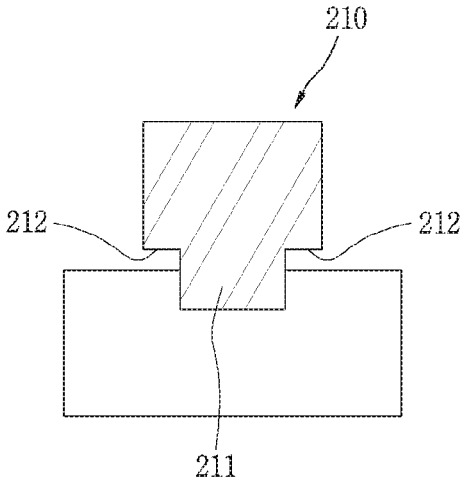
Figure 6C:
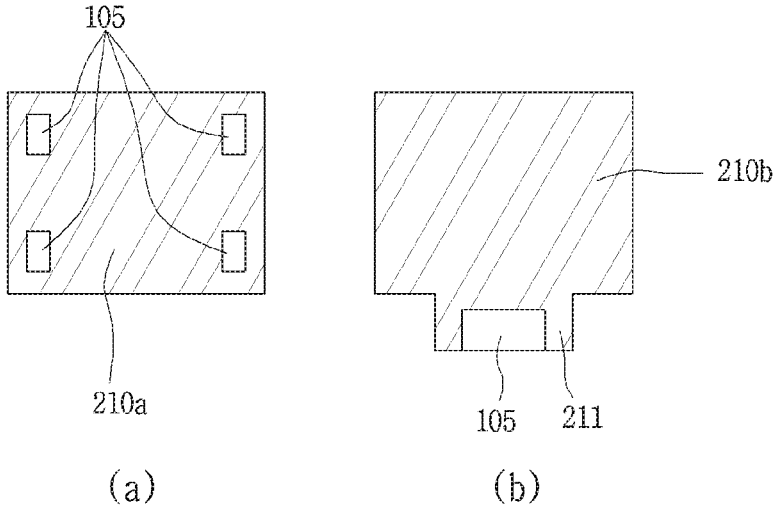

FIGS. 6A to 6C are conceptual views for explaining an antenna device including a gap between a dielectric substance and a circuit board.

Referring to FIG. 6A, first to third antenna units 203, 204, 205 are arranged along an edge of the circuit board 180 in parallel.

The first antenna unit 203 is arranged to form a gap (G) with the circuit board 180, and is connected to the antenna chip 230 by a pair of feeding portions 220. A dielectric substance 210*a* of the first antenna unit 203 is fixed to an inner frame 104 adjacent to the circuit board 180, etc.

Referring to FIG. 6C(a), the dielectric substance 210*a* of the first antenna unit 203 is fixed to the inner frame 104, etc. by an SMT method. A plurality of fixing pads 105 are formed on one surface of the dielectric substance 210*a*.

Referring to FIGS. 6A and 6C(b), a dielectric substance 210*b* of the second antenna unit 204 is fixed to the circuit board 180 by an SMT method. The dielectric substance 210*b* of the second antenna unit 204 includes a fixed portion 211, and a pair of recess portions 212 formed in a state that the fixed portion 211 is interposed therebetween. An SMT fixing pad 105 is formed at the fixed portion 211, and the fixed portion 211 is fixed to the circuit board 180 by an SMT method. That is, the fixed portion 211 comes in contact with the circuit board 180.

Gaps (G) are formed between the dielectric substance 210*b* and the circuit board 180 by the pair of recess portions 212. As shown, the pair of feeding portions 220 connected to the dielectric substance 210*b* are formed at an edge region of the dielectric substance 210*b* which encloses the recess portions 212.

Referring to FIG. 6A, a dielectric substance 210*c* of the third antenna unit 205 is fixed to one region of the circuit board 180 by an SMT method. Recess portions 181 are formed near the one region of the circuit board 180 where the dielectric substance 210*c* is fixed. The recess portions 181 are concaved from the edge of the circuit board 180, and gaps (G) are formed between the dielectric substance 210*c* and the circuit board 180 by the recess portions 181.

In the embodiments, since the gap (G) is formed between the circuit board 180 and the dielectric substance, a radiation pattern such as a YAGI antenna may be implemented.

Figure 7A:
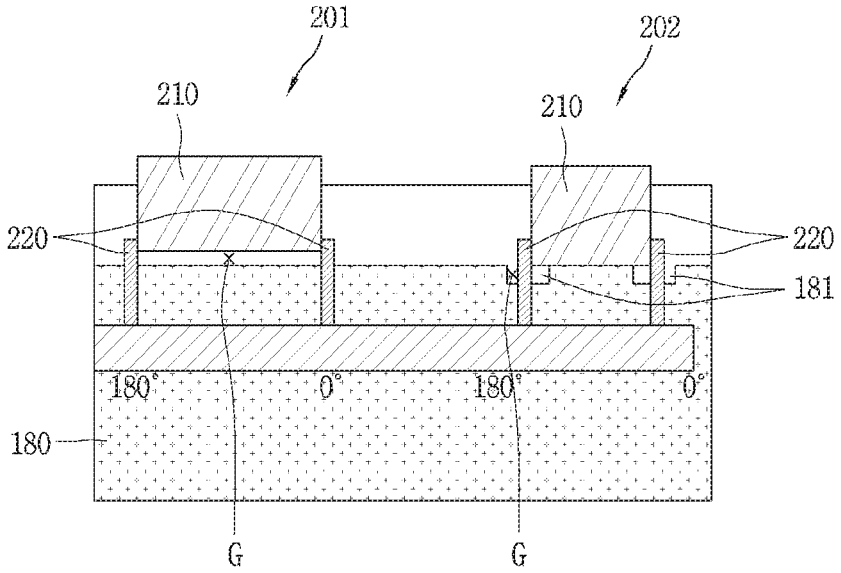
FIGS. 7A and 7B are conceptual views for explaining an antenna device including two feeding portions.
Figure 7B:
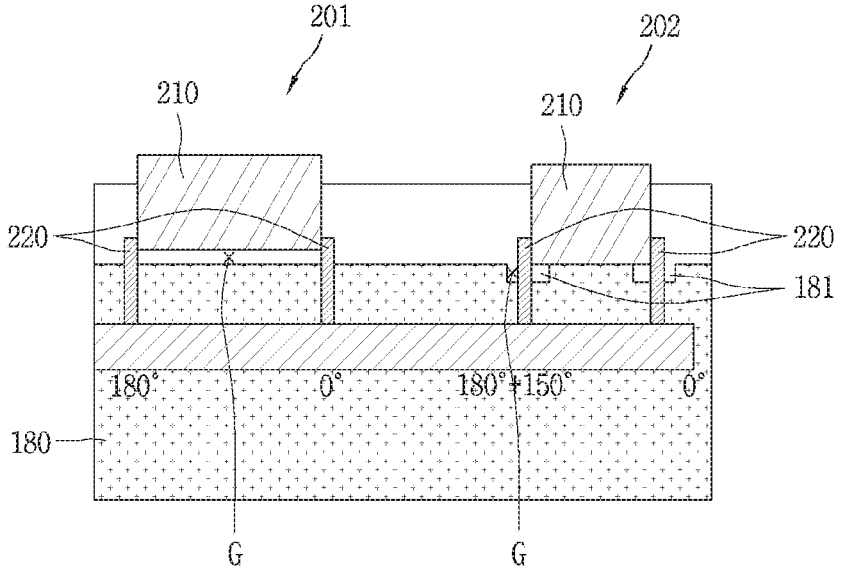

FIGS. 7A and 7B are conceptual views for explaining an antenna device including two feeding portions.

The antenna device includes first and second antenna units 201, 202, and each of the first and second antenna units 201, 202 includes a dielectric substance 210 and a pair of feeding portions 220. Fixing the dielectric substance 210 and the circuit board 180, and forming a gap (G) of a predetermined shape may be implemented by one of the first to third antenna units 203, 204, 205 shown in FIG. 6A.

Referring to FIG. 7A, the pair of feeding portions of each of the first and second antenna units 201, 202 supply a current to the dielectric substance 210 with a phase difference of 180°. If a current supplied to the first and second antenna units 201, 202 does not have a phase difference, a beam scanning does not occur. Thus, a radiation pattern towards a specific direction is formed.

Referring to FIG. 7B, the pair of feeding portions of the first antenna unit 201 supply a current to the dielectric substance 210 with a phase difference of 180°, and the pair of feeding portions of the second antenna unit 202 also supply a current to the dielectric substance 210 with a phase difference of 180°. If a current supplied to the first and second antenna units 201, 202 is set to have a phase difference of about 150°, a beam scanning occurs.

That is, a radiation pattern is formed in a first mode at about 0°~40° on the basis of the Z-axis, and a radiation pattern is formed in a mixed mode of first and second modes at about 40°~60°. And a radiation pattern is formed in a director mode of the second mode at about 60°~90°, in the same manner as a Yagi antenna.

Various embodiments may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). The processor may include the controller 180 of the electronic device.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. An electronic device, comprising:

a body;

a circuit board; and an antenna device configured to transceive a radio signal, wherein the antenna device is mounted to the body and comprises first and second antenna units, wherein each of the first and second antenna units comprises:

a dielectric substance;

an antenna chip disposed at the circuit board; and a pair of feeding portions configured to connect the antenna chip with the dielectric substance, wherein a gap is defined between the dielectric substance and the circuit board, wherein the electric substance comprises a fixed portion coupled to the circuit board, and a recessed portion wherein the gap is defined between the recessed portion and the circuit board.

2. The electronic device of claim 1, wherein the feeding portions each comprise:

a first region extending from the antenna chip; and a second region connected to the first region and formed on one surface of the dielectric substance, wherein the first and second regions define a specific angle therebetween.

3. The electronic device of claim 2, wherein the specific angle is 90°.

4. The electronic device of claim 3, wherein the second region is configured to have a trapezoid shape or an L-shape.

5. The electronic device of claim 1, wherein a surface-mount technology (SMT) fixing pad is disposed at the fixed portion.

6. The electronic device of claim 1, wherein:

the first and second antenna units are arranged along a first axis; and when power having a phase difference of 180° is supplied to the first and second antenna units, radiation patterns of the first and second antenna units are in opposite directions along the first axis.

7. The electronic device of claim 1, wherein:

the first and second antenna units are arranged along a first axis; and when power having the same phase is supplied to the first and second antenna units, radiation patterns of the first and second antenna units are in a same direction perpendicular to the first axis.

8. The electronic device of claim 1, wherein power having a phase difference of 180° is supplied to the pair of feeding portions.

9. The electronic device of claim 1, wherein the first and second antenna units are configured to radiate in a same direction or in opposite directions based on a phase difference of power supplied to the first and second antenna units.

10. The electronic device of claim 9, wherein the first and second antenna units are configured to radiate in the same direction as the phase difference is near zero.

11. The electronic device of claim 9, wherein:

the first and second antenna units are disposed at a first side of the electronic device; and the first and second antenna units are configured to radiate in the same direction extending outwardly from the first side when power having the same phase is supplied to the first and second antenna units.

12. The electronic device of claim 9, wherein:

the first and second antenna units are disposed at a first side of the electronic device;

the first and second antenna units are configured to radiate in the opposite directions respectively extending outwardly from a second side and a third side of the electronic device when power having a phase difference of 180° is supplied to the first and second antenna units; and the second side and third side are adjacent to the first side.

13. The electronic device of claim 12, wherein the first side corresponds to a top or bottom side of the electronic device and the second and third sides correspond to lateral sides of the electronic device.

14. An electronic device, comprising:

a body;

a circuit board; and an antenna device configured to transceive a radio signal, wherein the antenna device is mounted to the body and comprises first and second antenna units, wherein each of the first and second antenna units comprises:

a dielectric substance;

an antenna chip disposed at the circuit board; and a pair of feeding portions configured to connect the antenna chip with the dielectric substance, wherein a gap is defined between the dielectric substance and the circuit board, wherein the circuit board comprises a circuit board recessed portion at a region adjacent to an edge of the dielectric substance, and the gap is defined between the circuit board recessed portion and the dielectric substance.

* * * * *